US007802698B2

(12) United States Patent
Taylor et al.

(10) Patent No.: US 7,802,698 B2
(45) Date of Patent: Sep. 28, 2010

(54) APPARATUS TO INSERT ARTICLES INTO BAGS

(75) Inventors: Alfred A. Taylor, Lugarno (AU); Darren K. Alchin, Hammondville (AU)

(73) Assignee: TNA Australia Pty Limited, Lidcombe, New South Wales (AU)

( * ) Notice: Subject to any disclaimer, the term of this patent is extended or adjusted under 35 U.S.C. 154(b) by 190 days.

(21) Appl. No.: 11/436,205

(22) Filed: May 16, 2006

(65) Prior Publication Data

US 2006/0272741 A1 Dec. 7, 2006

(30) Foreign Application Priority Data

May 17, 2005 (AU) ..... 2005902515

(51) Int. Cl.
*B65G 59/04* (2006.01)

(52) U.S. Cl. ..... 221/210; 221/211; 221/200; 221/258; 221/9; 221/13; 221/268; 700/231; 141/313; 141/314

(58) Field of Classification Search ..... 221/1–312 C; 141/313–317; 700/231
See application file for complete search history.

(56) References Cited

U.S. PATENT DOCUMENTS

| | | | | |
|---|---|---|---|---|
| 4,018,358 | A * | 4/1977 | Johnson et al. | 221/7 |
| 4,658,564 | A | 4/1987 | Bell, Jr. et al. | |
| 5,209,046 | A * | 5/1993 | Tapscott et al. | 53/473 |
| 6,732,884 | B2 * | 5/2004 | Topliffe et al. | 221/3 |

FOREIGN PATENT DOCUMENTS

GB 1174527 A 12/1969

* cited by examiner

*Primary Examiner*—Gene Crawford
*Assistant Examiner*—Michael K Collins
(74) *Attorney, Agent, or Firm*—Townsend and Townsend and Crew, LLP

(57) ABSTRACT

An apparatus (15) to aid in locating articles in bags produced by a packaging machine (10). The apparatus (15) includes a reservoir (40) to which the articles are delivered, with a plurality of discharge locations being located at angular spaced positions about the reservoir (40). Each of the discharge locations (24) includes an upwardly facing aperture (25) through which the articles are delivered to a central chute (27) from where the articles are located in the bags being formed. Adjacent each discharge location (24) is a conveyor device (29) that moves angularly so as to take articles from the reservoir (40) to the associated aperture (25).

20 Claims, 4 Drawing Sheets

APPARATUS TO INSERT ARTICLES INTO BAGS

BACKGROUND OF THE INVENTION

The present invention relates to apparatus to insert (deposit) articles in bags and more particularly but not exclusively to insert articles such as flavor satchels, cards or toys into bags containing a food product, the food product for example being a snack food.

Frequently bags, such as bags containing a snack food, contain an article such as a flavor satchel or toy (cards).

Packaging machines include a former past which strip bag material is passed to be configured into a tubular form. Product to be packaged is delivered through the interior of the former to the interior of the tubular bag material. The bag material is longitudinally sealed, and transversely sealed and cut so that discrete bags are formed containing the food product.

Typically, the articles to be contained in the bags are delivered to the interior of the former so as to pass with the product into the tubular bag material.

Previously known devices that insert the above-mentioned articles suffer from a number of disadvantages, including slowness of operation and lack of accuracy with respect to ensuring that each bag contains the article or the required number of articles.

SUMMARY OF THE INVENTION

It is an object of the present invention to overcome or substantially ameliorate the above disadvantages.

There is disclosed herein an apparatus to aid in locating an article in a bag containing a product, the apparatus including:

a reservoir to receive a plurality of the articles and including an upwardly facing surface upon which the articles rest;

at least one discharge location, each location having a discharge aperture to which the articles are delivered to be conveyed to a packaging machine that forms bags containing the product; and a conveyor device to deliver the objects from the reservoir to the discharge aperture, the device including:

a support, the support being movable between a first position and a second position; and an article engaging portion attached to the support so as to be at least partly supported thereby, the article engaging portion being located adjacent the surface when the support is in the first position so as to engage one of the articles so that the article is secured thereto, with the surface being located relative to the discharge aperture so that upon release of the article engaged, the article is delivered to the discharge aperture when the support is in the second position.

Preferably, the support is moved angularly between the first and second positions.

Preferably, the support moves angularly about a generally horizontal axis.

Preferably, the article engaging portion includes a contact area to engage the articles, the contact area surrounding an aperture to which a reduced air pressure (relative to atmosphere) is delivered so that articles are urged against the contact area by air pressure.

Preferably, the reservoir surface is conical with a generally vertical longitudinal control axis so that the reservoir surface slopes downwardly to a generally annular periphery with the article engaging portion being located adjacent the periphery when the base is in the first position.

Preferably, the apparatus further includes an assembly to vibrate the reservoir surface.

Preferably, there is a plurality of discharge locations, and a plurality of conveyor devices, each conveyor device being operatively associated with a respective one of the discharge locations, with the discharge locations being angularly spaced about the axis.

Preferably, the apparatus further includes a motor operatively associated with each device to cause movement thereof between the first and second positions.

Preferably, the apparatus further includes a control to coordinate operation of the motors so that the articles are delivered to the discharge apertures in a desired timed sequence.

Preferably, the apparatus further includes a chute operatively associated with the discharge apertures so as to receive the articles therefrom so that the articles pass down the chute in the desired timed sequence.

Preferably, the apparatus further includes a hopper to receive a plurality of the articles, and a chute extending from the hopper to deliver the articles to the reservoir.

BRIEF DESCRIPTION OF THE DRAWINGS

A preferred form of the present invention will now be described by way of example with reference to the accompanying drawings wherein.

DESCRIPTION OF THE PREFERRED EMBODIMENTS

Figure 1:
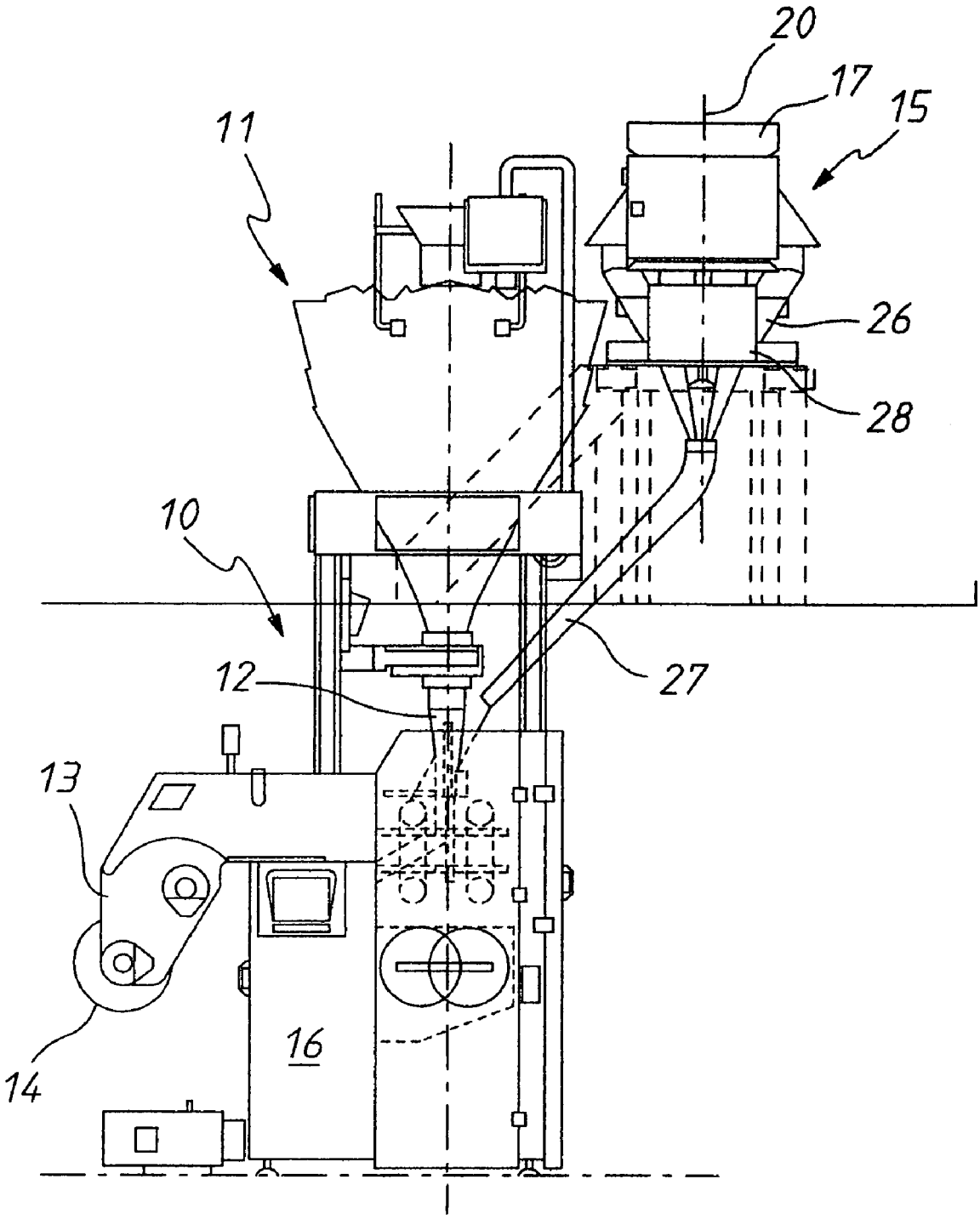
FIG. 1 is a schematic side elevation of a packing machine and apparatus to insert articles in bags produced by the packaging machine.

In the accompanying drawings there is schematically depicted a packaging machine 10. The packaging machine 10 may be the packaging machine described in U.S. Pat. No. 4,663,917. Located above the packaging machine 10 is a scale 11 that delivers batches of product to the interior of a former 12. Associated with the packaging machine 10 is a packaging film delivery device 13 that includes a reel 14 of strip bag material. The strip bag material is delivered to the former 12 so as to be configured into a tubular form. The packaging machine 10 longitudinally seals the tubular bag material and transversely seals and cuts the tubular bag material so that each bag formed contains a desired amount of product. The scale 11 includes gates that weigh the product and deliver the desired amount of product to the former 12 to be located in each bag.

Associated with the packaging machine 10 is an apparatus 15 that delivers to the former 12 articles to be located in the bags. For example, the apparatus 15 may deliver to the former 12 in a timed manner satchels of flavoring so that each bag produced contains a satchel. Accordingly the apparatus 15 is operatively associated with the packaging machine 10, together with the scale 11, by a control apparatus (computer) 16 so that the machine 10, scale 11 and apparatus 15 are co-ordinated.

The apparatus 15 includes a hopper 17 into which a relatively large number of the articles is delivered. The lower end of the hopper 17 has a chute 18 along which the articles slide to be delivered to an upwardly facing surface 19. Typically the surface 19 is of a conical configuration having a generally vertical longitudinal central axis 20. The surface 19 slopes downwardly from the apex at the axis 20 to a generally annular peripheral surface 21. The surface 21 has extending upwardly from it a wall 39 so that the surfaces 19 and 21, and wall 39, provide a reservoir 40 to receive the articles.

Figure 2:
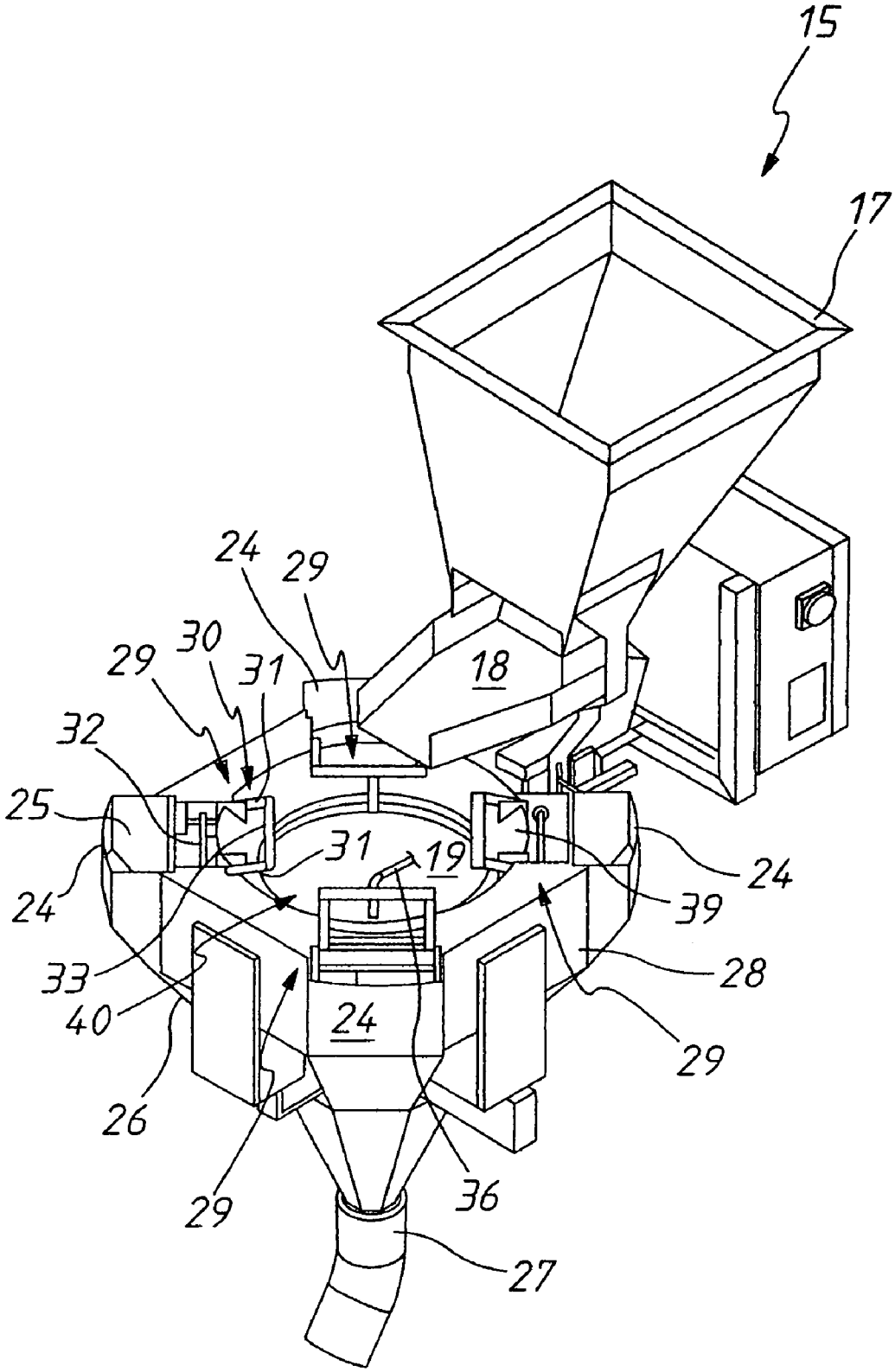
FIG. 2 is a schematic isometric view of the apparatus of FIG. 1.

The surface 19 is provided by a sheet member 22 attached to a drive assembly 23. The drive assembly 23 vibrates the surface 19 so that articles delivered thereto move towards the peripheral surface 21. As best seen in FIG. 2, the chute 18 delivers the articles to approximately the apex of the surface 19.

Surrounding the surface 19 is a plurality of stationary discharge locations 24 that include an upwardly facing discharge aperture 25, each aperture 25 leading to a chute 26 that leads to a central chute 27. Articles delivered to the apertures 25 pass down their respective chute 26 to be delivered to the central chute 27. The central chute 27 extends to the former 12.

The apparatus 15 includes a base 28 that generally surrounds the surface 19 and supports a plurality of conveying devices 29. Each conveying device 29 is operatively associated with a respective one of the apertures 25 so that each device 29 can transport an engaged one of the articles on the surface 19 and deliver it to the associated aperture 25 so that the article will find its way to the former 12 to be located in a bag to be formed by the packaging machine 10. The conveyor devices 29 are angularly spaced about the axis 20.

Each conveying device 29 includes an arm (support) 30 consisting of two elongated members 31 that are pivotally attached to the base 28 by means of a shaft 32. The elongated members 31 extend from the shaft 32 and are angularly moved thereby about a generally horizontal axis 38 provided by the respective shaft 32. Operatively associated with each shaft 32 is a motor 41 that drives the associated shaft 32 angularly so that the extremity of the elongated members 31 moves as best shown in FIG. 3, that is, through about 180°.

The extremities of each pair of members 31 is joined by a rod 33. Attached to each rod 33 is an article engaging portion 34 that terminates with a surface 35 that abuts an article to be lifted. Each portion 34 is supported by its respective arm 30. Each surface (area) 35 surrounds an aperture to which a reduced air pressure is delivered. More particularly each article engaging portion 34 is provided by a tubular member to which there is attached a flexible tube 36 extending to an air pump so that a reduced air pressure is delivered to the aperture surrounded by the respective area 35.

Each portion 34 is pivotally attached to the associated rod 33 so that the portion 34 remains generally vertically oriented.

Figure 3:
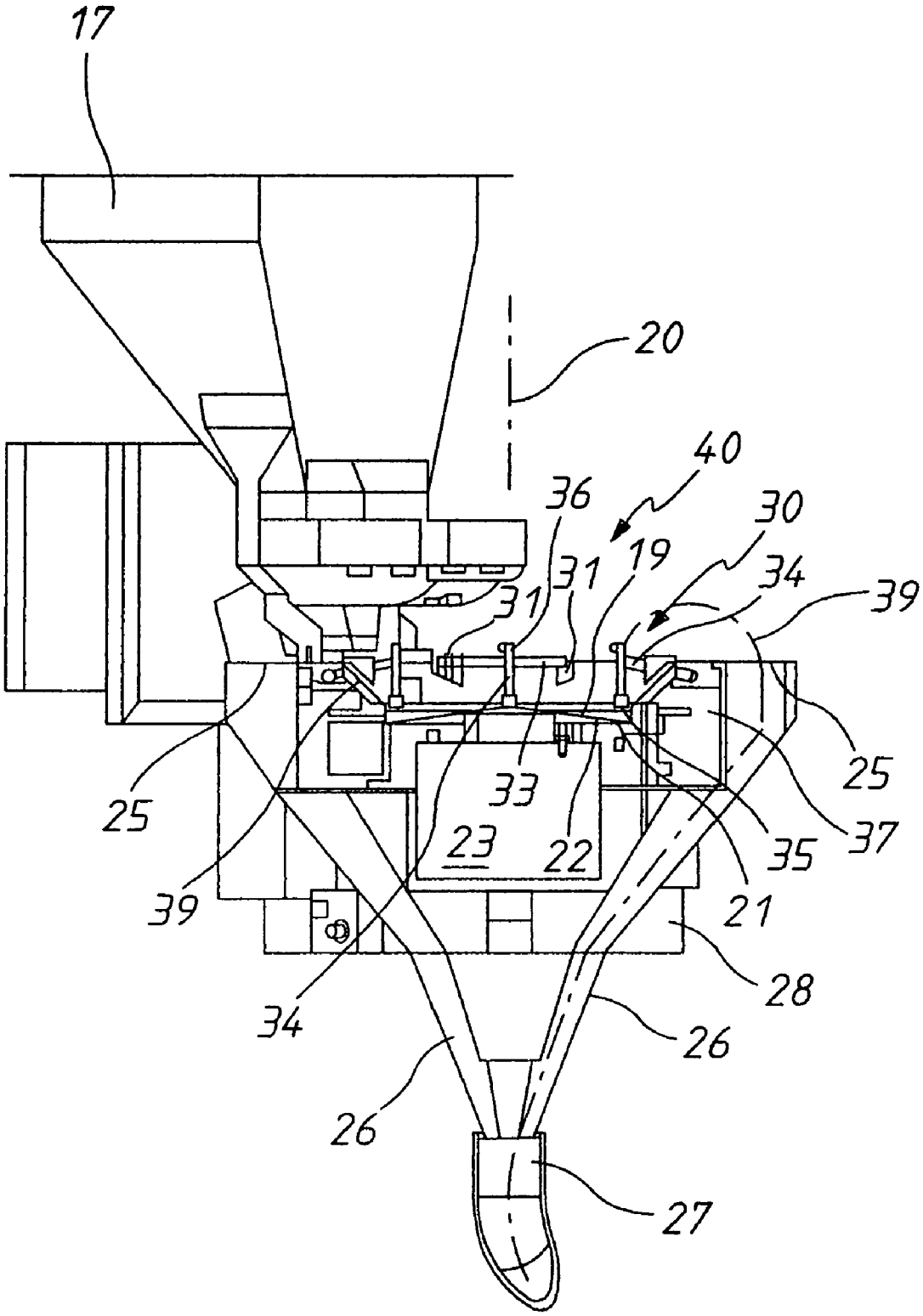
FIG. 3 is a schematic side elevation of the apparatus of FIG. 1.
Figure 4:
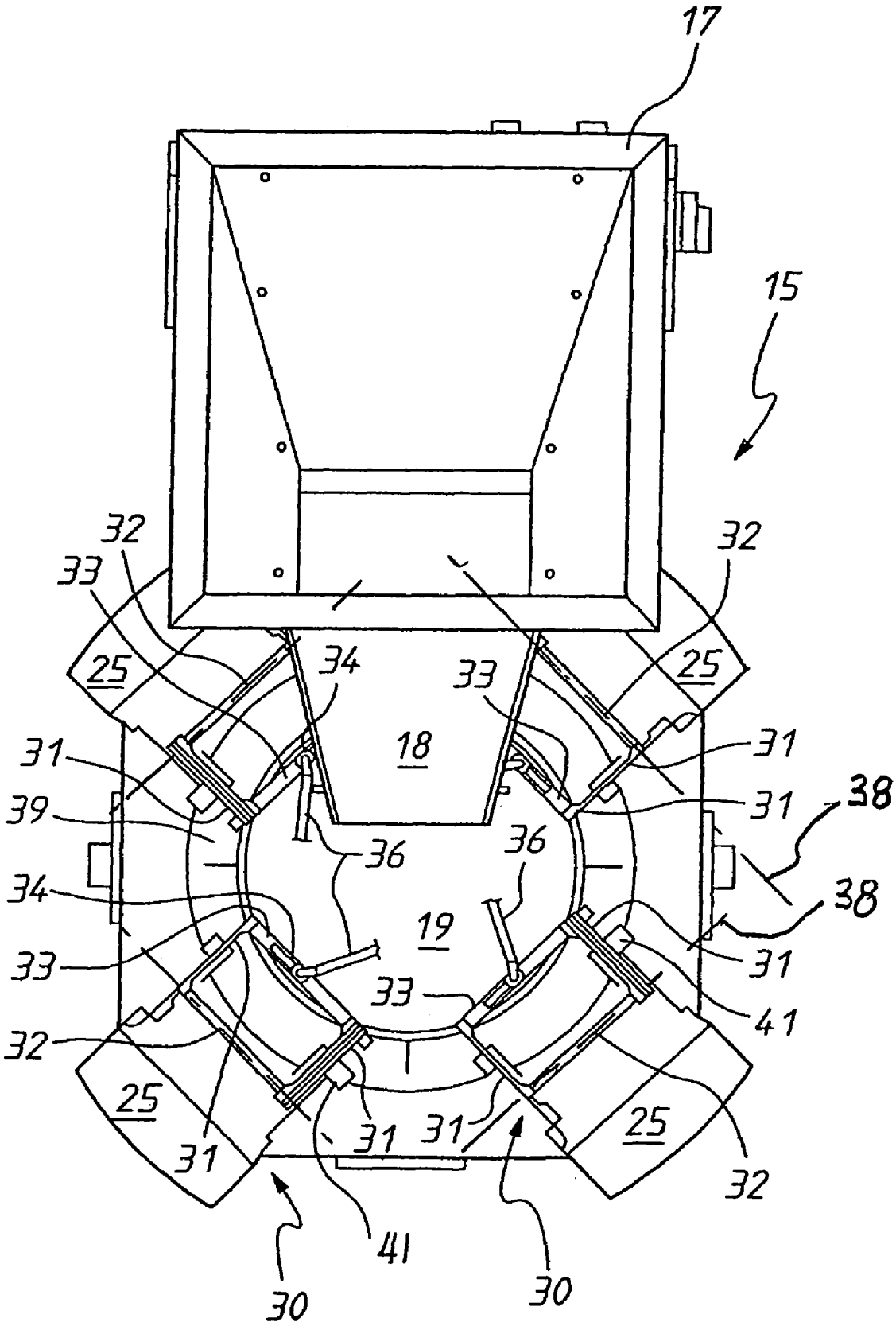
FIG. 4 is a schematic top plan view of the apparatus of FIG. 1.

As best seen in FIG. 3, when an article is engaged it is conveyed along a generally arcuate path 39 until it is above the adjacent aperture 35 whereat it is released.

Associated with each tube 36 is an air pump and control mechanism 37. The air pump and control mechanism 37 delivers reduced air pressure to the associated tube 36, however when each portion 34 is above its respective aperture 25, the vacuum in the tube 36 is dissipated and a positive air pressure pulse delivered to the tube 36 so that the article located above the respective aperture 25 is released and more particularly is propelled toward the aperture 25.

The pump and control mechanisms 37 are operatively associated with the control 16 so that the articles passing down the central chute 27 are spaced in a timed manner so that each bag receives one article or more articles if desired.

The shafts 32 are angularly driven so as to angularly oscillate (reciprocate) between a first position at which each portion 34 is located above its respective aperture, and a second position at which each portion 34 is located adjacent the peripheral surface 21 so as to pick up an article from the surface 19. When engaged an article is maintained against the surface 35 by air pressure until released.

The claims defining the invention are as follows:

1. An apparatus to aid in locating an article in a bag containing a product, said apparatus having a generally central vertical axis and including:

a reservoir to receive a plurality of the articles and including an upwardly facing surface extending from said axis and upon which the articles rest;

a plurality of stationary discharge locations arranged angularly about said axis, each location having a discharge aperture to which the articles are delivered to be conveyed to a packaging machine that forms bags containing the product; and a plurality of conveyor devices to deliver the articles from the reservoir to the discharge apertures, each device being operatively associated with a respective one of the locations and including:

a support, the support being movable between a first position and a second position by angular oscillation of the support between the first and second positions about a generally horizontal axis; and an article engaging portion attached to the support so as to be at least partly supported thereby, said article engaging portion being located adjacent said surface when said support is in said first position so as to engage one of the articles so that the article is secured thereto, with said surface being located relative to a respective one of the discharge apertures so that upon release of the article engaged, the engaged article is delivered to the respective one of the discharge apertures when said support is in said second position.

2. The apparatus of claim 1, wherein said article engaging portion includes a contact area to engage the articles, said contact area surrounding an aperture to which a reduced air pressure (relative to atmosphere) is delivered so that articles are urged against said contact area by air pressure.

3. The apparatus of claim 2, wherein the reservoir surface is conical with a generally vertical longitudinal central axis so that said reservoir surface slopes downwardly to a generally annular periphery with said article engaging portion being located adjacent said periphery when said support is in said first position.

4. The apparatus of claim 3, further including an assembly to vibrate said reservoir surface.

5. The apparatus of claim 4, further including a motor operatively associated with each support to cause movement thereof between the first and second positions.

6. The apparatus of claim 5, further including a control to co-ordinate operation of the motors so that the articles are delivered to the discharge apertures in a desired timed sequence.

7. The apparatus of claim 6, further including a chute operatively associated with the discharge apertures so as to receive the articles therefrom so that the articles pass down the chute in said desired timed sequence.

8. The apparatus of claim 7, further including a hopper to receive a plurality of the articles, and a chute extending from the hopper to deliver the articles to said reservoir.

9. The apparatus of claim 1, wherein the reservoir surface is conical with a generally vertical longitudinal central axis so that said reservoir surface slopes downwardly to a generally annular periphery with said article engaging portion being located adjacent said periphery when said support is in said first position.

10. The apparatus of claim 9, further including an assembly to vibrate said reservoir surface.

11. The apparatus of claim 10, further including a motor operatively associated with each support to cause movement thereof between the first and second positions.

12. The apparatus of claim 11, further including a control to co-ordinate operation of the motors so that the articles are delivered to the discharge apertures in a desired timed sequence.

13. The apparatus of claim 12, further including a chute operatively associated with the discharge apertures so as to receive the articles therefrom so that the articles pass down the chute in said desired timed sequence.

14. The apparatus of claim 13, further including a hopper to receive a plurality of the articles, and a chute extending from the hopper to deliver the articles to said reservoir.

15. The apparatus of claim 1, wherein the reservoir surface is conical with a generally vertical longitudinal central axis so that said reservoir surface slopes downwardly to a generally annular periphery with said article engaging portion being located adjacent said periphery when said support is in said first position.

16. The apparatus of claim 15, further including an assembly to vibrate said reservoir surface.

17. The apparatus of claim 16, further including a motor operatively associated with each support to cause movement thereof between the first and second positions.

18. The apparatus of claim 17, further including a control to co-ordinate operation of the motors so that the articles are delivered to the discharge apertures in a desired timed sequence.

19. The apparatus of claim 18, further including a chute operatively associated with the discharge apertures so as to receive the articles therefrom so that the articles pass down the chute in said desired timed sequence.

20. The apparatus of claim 15, further including a hopper to receive a plurality of the articles, and a chute extending from the hopper to deliver the articles to said reservoir.

* * * * *